252-95 AU 166 EX
6/17/80 XR 4,208,295

United States Patent [19]
Sai et al.
[11] 4,208,295
[45] Jun. 17, 1980

[54] BLEACHING DETERGENT COMPOSITION

[75] Inventors: Fumio Sai, Chiba; Takashi Fujino, Yokohama, both of Japan

[73] Assignee: Kao Soap Co., Ltd., Tokyo, Japan

[21] Appl. No.: 5,656

[22] Filed: Jan. 22, 1979

[30] Foreign Application Priority Data

Jan. 25, 1978 [JP] Japan ..... 53-6876
Jan. 25, 1978 [JP] Japan ..... 53-6877

[51] Int. Cl.[2] ..... C11D 3/395; C11D 7/54
[52] U.S. Cl. ..... 252/94; 252/95; 252/99; 252/135; 252/186; 8/111
[58] Field of Search ..... 252/94, 95, 135, 99, 252/186; 8/111

[56] References Cited

U.S. PATENT DOCUMENTS 3,413,229 11/1968 Bianco et al. ..... 252/94 X
4,083,795 4/1978 Joubert ..... 252/94 X

*Primary Examiner*—Mayer Weinblatt
*Attorney, Agent, or Firm*—Blanchard, Flynn, Thiel, Boutell & Tanis

[57] ABSTRACT

A bleaching detergent composition comprises (i) a water-insoluble aluminosilicate having a degree of crystallization of 0 to 75% or a water-insoluble aluminosilicate having exchangeable cations partially substituted by calcium and/or magnesium ions, (ii) a surface active agent and (iii) sodium percarbonate. It is very much improved in respect to the storage stability of the sodium percarbonate.

13 Claims, No Drawings

BLEACHING DETERGENT COMPOSITION

The present invention relates to a bleaching detergent composition comprising a water-insoluble aluminosilicate. More particularly, the invention relates to a bleaching detergent composition comprising a water-insoluble aluminosilicate, in which the storage stability of sodium percarbonate ($Na_2CO_3 \cdot 3/2H_2O_2$) is improved.

It has previously been tried to reduce the amount of sodium tripolyphosphate used as a principal builder of detergents, since it causes a problem of eutrophication of lakes and marshes. Various substitutes for sodium tripolyphosphate have been developed and proposed. Among those substitutes, water-insoluble aluminosilicates (zeolites) are now regarded as most important. Processes for preparing those aluminosilicates and uses thereof are disclosed in, for example, the specifications of Japanese Patent Laid-Open Nos. 12381/1975, 21009/1975, 53404/1975, 70409/1975 and 62315/1977. Those aluminosilicates are shown by the formula:

$$X'(M'_2O \text{ or } M''O)\cdot(Al_2O_3)\cdot Y'(SiO_2)\cdot W\cdot(H_2O) \quad [1]$$

wherein M' is an alkali metal, M'' is an alkaline earth metal replaceable for calcium, and X', Y' and W' each are the mole number of each component, in general:

$0.7 \leqq X' \leqq 1.5$ $0.8 \leqq Y' \leqq 6$ and

W' is a positive number.

Among the water-insoluble aluminosilicates of the above formula [1], completely crystalline aluminosilicate of the 4A-type $[(Na_2O)\cdot(Al_2O_3)\cdot 2.0(SiO_2).4.5(H_2O)]$ is most important and it is used as a builder for detergents at present.

However, when sodium percarbonate as a peracid compound is incorporated in detergents containing the completely crystalline aluminosilicate of the A-type, the stability is reduced remarkably with the passing of time. On the other hand, the problem of stability is not caused when the peracid compound is sodium perborate. Under the circumstances pointed out as above, an improvement is demanded.

Sodium percarbonate attracts attention as a future starting material of a bleaching agent from viewpoint of the energy saving, since it exhibits an excellent bleaching effect even at a low temperature, while sodium perborate exhibits the effect only at a high temperature. Thus, the stabilization of sodium percarbonate is a big problem. The following processes for improving the age stability of sodium percarbonate have been proposed:

(a) process wherein sodium percarbonate is coated with a hydrophobic substance or the like, (b) process wherein magnesium silicate is incorporated in a detergent composition containing sodium percarbonate, (c) process wherein a chelating agent which forms an easily water-soluble metal chelated compound such as nitrilotriacetate (NTA) or ethylene diamine tetraacetate (EDTA) is incorporated in a detergent composition.

(d) process wherein a chelating agent which forms a difficulty water-soluble or water-insoluble metal chelated compound such as salicylic acid aldoxime or -benzoyl oxime is incorporated in a detergent composition.

Even if a bleaching detergent composition containing sodium percarbonate and 4A-type aluminosilicate is treated by those processes for improving the age stability of sodium percarbonate, reduction in age stability could not be prevented.

It is known that sodium perborate as the bleaching agent has a high bleaching effect at high temperatures but the effect is lowered at low temperatures. On the other hand, sodium percarbonate has an effective bleaching action even at low temperatures and is very valuable from the viewpoint of saving of energy. However, the above-mentioned poor storage stability of sodium percarbonate is a fatal defect of the 4A-type aluminosilicate builder.

After intensive investigations on the age-stabilization of sodium percarbonate in detergents containing an aluminosilicate, the inventors have found that the age stability of sodium percarbonate can be improved remarkably by using a water-insoluble aluminosilicate of the formula [I] having a degree of crystallization of from 0 (amorphous) to 75% or a water-insoluble aluminosilicate of the formula (II) in which the exchangeable cations are partially substituted by calcium and/or magnesium ions.

The aluminosilicate (I) of the invention is shown by the formula (I):

$$X(M_2O)\cdot(Al_2O_3)\cdot Y(SiO_2)\cdot W(H_2O) \quad [I]$$

wherein M is sodium and/or potassium, X, Y and W each are the mole number of each component in the following range:

$0.7 \leqq X \leqq 1.2$ $1.8 \leqq Y \leqq 2.2$ and

W is zero or a positive number.

The water-insoluble aluminosilicate (I), which has various degrees of crystallization, can be obtained easily by controlling the reaction time and the reaction temperature in the synthesis of the aluminosilicates. A typical process for this is shown in Example 1 described later.

It is desirable that the water-insoluble aluminosilicate further satisfies the following condition: The water-insoluble aluminosilicate preferably has a calcium ion-replaceable ability of more than 150 mg (calculated as calcium carbonate), particularly more than 200 mg, per gram of the aluminosilicate anhydride. In addition it is preferred that it has a particle diameter of less than 100 microns, especially less than 50 microns, more particularly less than 10 microns.

The aluminosilicate (II) of the invention is shown by the formula (II):

$$A(M^{+}{}_2O)\cdot B(M^{2+}O)\cdot(Al_2O_3)\cdot C(SiO_2)\cdot D(H_2O) \quad (II)$$

wherein $M^+$ is an alkali metal, $M^{2+}$ is calcium and/or magnesium, and A, B, C and D each are the mole number of respective components, in which A and B are a positive number with proviso that $0.7 \leqq A+B \leqq 1.2$ and $B/A+B=0.001$ to 0.1, C is a number in the range between 1.6 and 2.2, and D is a positive number. It is preferred that $M^+$ is sodium and/or potassium.

In the water-insoluble aluminosilicate (II), the substitution ratio of exchangeable cations by calcium and/or magnesium ions is preferably at least 0.1 mole %, especially at least 1 mole %. By the way, the water-insoluble aluminosilicate (II) is required to maintain a high activity to remove water-hardening components contained in a washing aqueous solution, that is, a sufficient ion-exchange property. Accordingly it is desired that the ratio of substitution by calcium and/or magnesium ions is not more than 10 mole %, whereby no particular disadvantage is brought about by use of the aluminosilicate as the detergent builder.

The aluminosilicate of the formula (I) can easily be prepared batchwise or continuously by washing a crude product in the synthesis of an aluminosilicate, using hard water instead of deionized water. Embodiments of this will be described in Examples given hereinafter.

The aluminosilicate of the present invention of the formula (I) may be crystalline or amorphous, or a mixture thereof. It is preferred that its particle size be not more than 100μ, especially not more than 50μ, more especially not more than 10μ. The calcium ion-exchanging property of the aluminosilicate (I) is preferably at least 150 mg, especially at least 200 mg, calculated as calcium carbonate, per gram of aluminosilicate anhydride.

The invention provides a bleaching detergent composition comprising (i) a water-insoluble aluminosilicate of the formula (I) or (II), (ii) a surface active agent selected from anionic surface active agents, non-ionic surface active agents, amphoteric surface active agents and mixtures thereof, and (iii) sodium percarbonate.

Preferred proportions of the components (i) to (iii) are 3 to 50% by weight of the aluminosilicate, 5 to 50% by weight of the surface active agent and 3 to 50% by weight of sodium percarbonate (III). Furthermore it is more preferred that the amount of the aluminosilicate (I) is 5 to 50 wt.%.

Various anionic surface active agents, non-ionic surface active agents and amphoteric surface active agents may be used in the present invention as the surface active agent singly or in the form of a mixture of two or more of them. It is preferred that the surface active agent be incorporated in an amount of 5 to 50% by weight, especially 10 to 30% by weight. When the aluminosilicate (II) is used, it is more preferred that the amount of the surfactant is 3 to 50 wt.%. As the counter ion of the anionic surface active agent, there can be mentioned ions of alkali metals such as sodium and potassium, ions of alkaline earth metals such as calcium and magnesium, an ammonium ion, and salts of alkanol amines having 1 to 3 alkanol groups including 2 to 3 carbon atoms (such as monoethanol amine, diethanol amine, triethanol amine and triisopropanol amine).

The aluminosilicate [I] is prepared by mixing an aqueous solution or suspension of an aluminum salt, an aqueous solution or suspension of a silicate and an aqueous solution of an alkali, then heating, while agitating, the obtained mixture at 5° to 100° C. for 5 minutes to 72 hours. The aluminum salt to be used here includes sodium aluminate, aluminum sulfate, aluminum nitrate, aluminum chloride and aluminum hydroxide. The silicate includes sodium metasilicate, sodium silicates, such as No. 1, No. 2 and No. 3 defined by the Japanese Industrial Standards, and other alkali metal silicates, and colloidal silica. The alkali to be used here includes sodium hydroxide and potassium hydroxide.

The aluminosilicate [II] is prepared by treating an aluminosilicate having a crystallization degree of 0 to 100% with an aqueous solution containing calcium or magnesium ion, so that exchangeable counter-ions in the aluminosilicate may be in part substituted by magnesium and/or calcium ions.

Preferred examples (1) to (13) of the surface active agent will now be described.

(1) Linear or branched alkylbenzene-sulfonates having an alkyl group having 10 to 16 carbon atoms on the average.

(2) Alkyl or alkenyl ethoxysulfates having a linear or branched alkyl or alkenyl group having 8 to 20 carbon atoms on the average and having 0.5 to 8 moles, on the average, of ethylene oxide added per molecule.

(3) Alkyl or alkenyl sulfates having an alkyl or alkenyl group having 10 to 20 carbon atoms on the average.

(4) Olefin-sulfonates having 10 to 20 carbon atoms on the average in the molecule.

(5) Alkane sulfonates having 10 to 20 carbon atoms on the average in the molecule.

(6) Saturated or unsaturated fatty acid salts having 10 to 20 carbon atoms on the average in the molecule.

(7) Alkyl or alkenyl ethoxycarboxylic acid salts having an alkyl or alkenyl group having 10 to 20 carbon atoms on the average and having 0.5 to 8 moles, on the average, of ethylene oxide added per molecule.

(8) Polyoxyethylene alkyl or alkenyl ethers having an alkyl or alkenyl group having 8 to 20 carbon atoms on the average and having 3 to 12 moles of ethylene oxide added.

(9) Polyoxyethylene alkylphenyl ethers having an alkyl group having 8 to 12 carbon atoms on the average and having 3 to 12 moles of ethylene oxide added.

(10) Alkylamine oxides represented by the following formula:

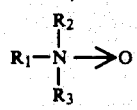

wherein $R_1$ stands for an alkyl or alkenyl group having 10 to 20 carbon atoms, and $R_2$ and $R_3$, which may be the same or different, stand for an alkyl group having 1 to 3 carbon atoms.

(11) Higher fatty acid alkanol amides and alkylene oxide adducts thereof represented by the following formula:

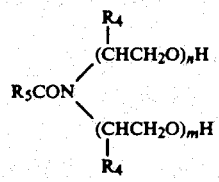

wherein $R_4$ stands for H or $CH_3$, $R_5$ stands for an alkyl or alkenyl group having 10 to 20 carbon atoms, n is an integer of 1 to 3, and m is an integer of 0 to 3.

(12) Amphoteric surface active agents represented by the following formula:

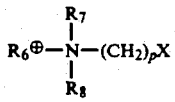

wherein $R_6$ stands for an alkyl or alkenyl group having 10 to 20 carbon atoms, $R_7$ and $R_8$ stand for an alkyl group having 1 to 4 carbon atoms, p is an integer of 1 to 3, and X stands for a group $—COO^{\ominus}$ or $—SO_3^{\ominus}$.

(13) α-Sulfo-fatty acid salts and esters represented by the following formula:

$$R_9CHCO_2Y$$
$$|$$
$$SO_3Z$$

wherein Y stands for an alkyl group having 1 to 3 carbon atoms or a counter ion exemplified above with respect to the anionic surface active agent, Z is a counter ion exemplified above with respect to the anionic surface active agent, and $R_9$ stands for an alkyl or alkenyl group having 10 to 20 carbon atoms.

The composition of the present invention may comprise, in addition to the water-insoluble aluminosilicate represented by the general formula (I), 0 to 50% by weight of at least one alkali metal salt as the polyvalent metal ion sequestering agent. As such alkali metal salt, there can be mentioned alkali metal salts of condensed phosphoric acids such as orthophosphoric acid tripolyphosphoric acid, pyrophosphoric acid and metaphosphoric acid, alkali metal salts of aminopolyacetic acids such as nitrilotriacetic acid, ethylenediaminetetraacetic acid and diethylenetriamine-pentaacetic acid, alkali metal salts of polyhydroxycarboxylic acids such as citric acid, malic acid and glycolic acid, and polymeric electrolytes such as alkali metal hydrolyzate salts of polyacrylic acid and vinyl acetate/maleic anhydride copolymers.

Further, the composition of the present invention may comprise as the alkaline agent or inorganic electrolyte at least one alkali metal salt selected from alkali metal silicates, alkali metal carbonates and alkali metal sulfates in an amount of 1 to 50% by weight, preferably 5 to 30% by weight.

Still further, the composition of the present invention may comprise as the re-contamination preventing agent at least one member selected from polyethylene glycol, polyvinyl alcohol, polyvinyl pyrrolidone and carboxymethyl cellulose in an amount of 0.1 to 5% by weight.

Moreover, according to need, the composition of the present invention may comprise a sodium percarbonate stabilizer such as magnesium silicate, an oxygen bleaching type activator such as glucose pentaacetate and other bleaching agent such as sodium perborate. Still further, a commercially available fluorescent dye may be incorporated as a whitening agent, and such additives as a perfume, an enzyme and a bluing agent may be further incorporated.

As will be apparent from the foregoing illustration, according to the present invention, the storage stability of sodium percarbonate with the passing of time can be remarkably improved, and a bleaching detergent composition having a high bleaching effect even at low temperatures can be provided.

The present invention will now be described in detail by reference to the following Examples that by no means limit the scope of the invention.

EXAMPLE 1

[Synthesis of Aluminosilicates of Present Invention]

(1) To 64.0 g of an aqueous solution of aluminum sulfate having an $Al_2O_3$ concentration of 8% was added an aqueous solution formed by adding 18 g of a 40% aqueous solution of sodium silicate ($Na_2O:SiO_2=1:2.5$) and 11.6 g of sodium hydroxide to 100 cc of deionized water. The mixture was agitated at 95° C. to advance the reaction. After 1.5 hours, the reaction product was recovered by filtration under suction. The reaction product was washed batchwise with 2 l of hard water of 10° DH (Ca:Mg=4:1), and the product was recovered by filtration. The washed product was dried at 105° C. to obtain a product (S-1). As a result of the X-ray diffractiometry, it was found that the product (S-1) was amorphous. As a result of the chemical analysis, it was found that the product (S-1) had a composition of $0.81(Na_2O)\cdot0.06(CaO)\cdot0.01(MgO)\cdot(Al_2O_3)\cdot1.8(SiO_2)\cdot6.3(H_2O)$.

(2) To an aqueous solution formed by dissolving 10 g of sodium aluminate in 50 cc of deionized water was added an aqueous solution formed by adding 17 g of a 40% aqueous solution of sodium silicate ($Na_2O:SiO_2=1:2.5$) and 6.8 g of sodium hydroxide to 50 cc of deionized water. The mixture was agitated at 95° C. to advance the reaction. After 1.5 hours, the reaction product was recovered by filtration under suction, washed batchwise with 1.8 l of hard water of 5° DH (calcium hard water), filtered and dried at 105° C. to obtain a product (S-2). As a result of the X-ray diffractiometry, it was found that the product (S-2) had substantially the same crystal structure as that of the 4A-type alkali metal aluminosilicate. As a result of the chemical analysis, it was found that the product (S-2) had a composition of $0.92(Na_2O)\cdot0.08(CaO)\cdot(Al_2O_3)\cdot2.01(SiO_2)\cdot4.8(H_2O)$.

(3) A commercially available 4A-type sodium aluminosilicate product ("Molecular Sieve 4A" manufactured by Showa-Unox Co.) was agitated in hard water containing calcium and/or magnesium, filtered and dried to obtain the following 4A-type aluminosilicates (S-3) to (S-8) partially substituted by calcium and/or magnesium ions:

S-3: $0.79(Na_2O)\cdot0.15(CaO)\cdot0.06(MgO)\cdot(Al_2O_3)\cdot2.0(SiO_2)\cdot4.2(H_2O)$ S-4: $0.3(Na_2O)\cdot0.7(MgO)\cdot(Al_2O_3)\cdot2.0(SiO_2)\cdot4.0(H_2O)$ S-5: $0.93(Na_2O)\cdot0.07(MgO)\cdot(Al_2O_3)\cdot2.0(SiO_2)\cdot4.1(H_2O)$ S-6: $0.99(Na_2O)\cdot0.01(CaO)\cdot(Al_2O_3)\cdot2.0(SiO_2)\cdot4.0(H_2O)$ S-7: $0.95(Na_2O)\cdot0.05(CaO)\cdot(Al_2O_3)\cdot2.0(SiO_2)\cdot4.0(H_2O)$ S-8: $0.9(Na_2O)\cdot0.1(CaO)\cdot(Al_2O_3)\cdot2.0(SiO_2)\cdot4.2(H_2O)$ Results of experiments made on the calcium ion exchange speed are shown in Table 1, from which it will readily be understood that when the calcium substitution ratio exceeds 10 mole %, the calcium ion exchange speed is reduced.

Table 1

| Calcium substitution Ratio (mole %) in Aluminosilcate | Calcium Ion Exchange Speed ($CaCO_3$ mg/g anhydride) | | | |
|---|---|---|---|---|
| | 1 minute | 3 minutes | 5 minutes | 15 minutes |
| 0% | 228 | 263 | 279 | 294 |
| 8 (S-2) | 215 | 260 | 266 | 270 |
| 8 (S-1) | 220 | 232 | 240 | 245 |
| 21 (S-3) | 130 | 165 | 193 | 215 |

Values of the ion exchange speed shown in the above Table were values of the ion exchange capacity obtained by conducting the measurement according to the following method.

[Measurement Method]

To 200 ml of calcium chloride hard water (having a concentration of 500 ppm as calcium carbonate) was added 0.2 g of a sample, and at room temperature, the mixture was agitated for a predetermined time while maintaining the pH at 10 (by addition of NaOH or HCl), and the mixture was filtered. The hardness ($H_1$) of water before addition of the sample and the hardness ($H_2$) of the filtrate were determined according to the EDTA titration method. The calcium ion exchange was calculated according to the following formula:

$$\text{Calcium ion exchange capacity} = \frac{H_1 - H_2}{\text{weight (g) of sample in 1 l}}$$

EXAMPLE 2

0.85 g of sodium percarbonate was homogeneously mixed with 1 g (as anhydride) of an aluminosilicate, and the mixture was allowed to stand for 2 days at a temperature of 40° C. and a relative humidity of 80%. The residual effective oxygen concentration was measured after 2 days' standing, and the residual activity was expressed in terms of the ratio (%) of the residual effective oxygen concentration to the initial effective oxygen concentration. Obtained results are shown in Table 2.

Table 2

| Ratio (mole %) of Substitution by Calcium and/or Magnesium in Aluminosilicate | Effective Oxygen Residual Ratio (%) |
|---|---|
| 0 | 43.7 |
| 1 (S-6) | 77.2 |
| 5 (S-7) | 84.0 |
| 8 (S-2) | 84.0 |
| 10 (S-8) | 85.2 |
| 21 (S-3) | 89.2 |
| 70 (S-4) | 85.8 |

As is apparent from the results shown in Table 2, in each of the aluminosilicates partially substituted by calcium and/or magnesium, a good effective oxygen residual ratio was obtained.

EXAMPLE 3

Bleaching detergent compositions having a recipe indicated below, in which sodium percarbonate and aluminosilicate were incorporated according to the post addition method, were allowed to stand for 10 days under high humidity conditions (at a temperature of 30° C. and a relative humidity higher than 80%), and the residual effective oxygen ratio was determined to obtain results shown in Table 3.

Table 3

| Calcium and/or Magnesium Substitution Ratio (mole %) in Aluminosilicate) | Effective Oxygen Residual Ratio (%) |
|---|---|
| 0 | 44.8 |
| 1 (S-6, partially substituted by Ca) | 85.3 |
| 8 (S-1, partially substituted by Ca/Mg) | 94.5 |
| 10 (S-8, partially substituted by Ca) | 90.7 |
| 21 (S-3, partially substituted by Ca/Mg) | 91.0 |

| Recipe | |
|---|---|
| Sodium linear-dodecylbenzene-sulfonate | 10% by weight |
| Sodium alkyl sulfate (derived from oxo-alcohol having 14.5 carbon atoms on the average) | 5% by weight |
| Sodium alkylethoxy sulfate (derived from oxo-alcohol having 12.8 carbon atoms on the average and having 1.5 moles of ethylene oxide added on the average) | 5% by weight |

Table 3-continued

| | |
|---|---|
| Sodium tripolyphosphate | 15% by weight |
| Aluminosilicate | 15% by weight |
| Sodium silicate | 5% by weight |
| Sodium percarbonate | 20% by weight |
| Magnesium silicate | 1% by weight |
| Perfume, fluorescent dye, water, sodium sulfate | balance |

In each of aluminosilicates partially substituted by calcium and/or magnesium, a good storage stability could be attained under high humidity conditions, but in the case of the sodium type aluminosilicate, the effective oxygen residual ratio was only 44.8% and the stability was very poor.

EXAMPLE 4

[Washing Test]

In order to evaluate the effect of an alkali metal aluminosilicate partially substituted by calcium and/or magnesium as the builder, a detergent composition having a recipe indicated below was prepared, and an artificially contaminated cloth was washed by this detergent composition and the washing ratio was determined. Obtained results are shown in Table 4.

[Recipe]

Sodium linear-dodecylbenzene-sulfonate: 20% by weight
Sodium aluminosilicate partially substituted by Ca/Mg: 20% by weight
Sodium silicate: 5% by weight
Sodium percarbonate: 5% by weight
Fluorescent dye: 0.3% by weight
Water: 10% by weight
Sodium sulfate: 41.7% by weight (1) Preparation of Artificially Contaminated Cloth A cotton cloth having a size of 10 cm×10 cm was solid with an oil composition having a recipe indicated below and a small amount of carbon black.
Cotton seed oil: 60% by weight
Cholesterol: 10% by weight
Oleic acid: 10% by weight
Palmitic acid: 10% by weight
Liquid and solid paraffins: 10% by weight (2) Calculation of Washing Ratio The reflectance at 550 mμ was measured with respect to the sample cloth before and after the washing operation by means of an automatic recording colorimeter (manufactured by Shimazu Seisakusho), and the washing ratio D (%) was calculated according to the following formula:

$$D = \frac{L_2 - L_1}{L_0 - L_1} \times 100$$

wherein $L_0$ stands for the reflectance of the starting cloth, $L_1$ stands for the reflectance of the contaminated cloth before washing, and $L_2$ stands for the reflectance of the contaminated cloth after washing.

(3) Washing Method

The washing operation was carried out by using a Terg-O-Meter at 100 rpm under the following conditions:

Bath ratio: 1/60
Water temperature: 20° C.
Washing time: 10 minutes
Rinsing: 5 minutes with service water
Hardness of water: 4° DH (calcium hard water)

Table 4

| Aluminosilicate | Washing Ratio D (%) |
|---|---|
| not added | 30 |
| Ca/Mg substitution ratio of 0 mole % | 61 |
| Ca substitution ratio of 1 mole % (S-6) | 61 |
| Mg substitution ratio of 7 mole % (S-5) | 58 |
| Ca/Mg substitution ratio of 8 mole % (S-1) | 57 |
| Ca substitution ratio of 10 mole % (S-8) | 57 |
| Ca/Mg substitution ratio of 21 mole % (S-3) | 49 |

From the above results, it is apparent that the aluminosilicate having a calcium and/or magnesium substitution ratio higher 10 mole % inferior in the washing power and the effect of the builder was insufficient.

EXAMPLE 5

Synthesis

Aluminosilicates having various crystallization degrees, in which a part of the exchangeable cations had been substituted by calcium ions, was obtained. Table 5 shows synthesis conditions, crystal form, crystallization degrees and analytical values in the examples.

Table 5

| Sample No. | reaction temp. | reaction time | crystal form | degree of crystallization | Chemical Composition |
|---|---|---|---|---|---|
| S-9 | 95° C. | 20 min. | A type | 30% | $0.85(Na_2O) . 0.07(CaO) . (Al_2O_3) . 1.90(SiO_2) . 4.2(H_2O)$ |
| S-10 | 95° C. | 40 min. | A type | 50 | $0.88(Na_2O) . 0.08(CaO) . (Al_2O_3) . 1.90(SiO_2) . 4.4(H_2O)$ |
| S-2 | 95° C. | 1.5 hours | A type | 75 | $0.92(Na_2O) . 0.08(CaO) . (Al_2O_3) . 2.01(SiO_2) . 4.8(H_2O)$ |
| S-11 | 95° C. | 4 hours | A type | 100 | $0.90(Na_2O) . 0.09(CaO) . (Al_2O_3) . 2.00(SiO_2) . 4.4(H_2O)$ |

Stability test of sodium percarbonate 0.85 g of sodium percarbonate and 1 g of aluminosilicate (weighed as its anhydride) were uniformly mixed and the resulting mixture was allowed to stand at 30° C., at a relative humidity of 80% for 7 days. After that, the concentration of the remaining effective oxygen of the percarbonate was measured and the remaining activity was calculated in each case in the form of the percentage against the initial effective oxygen concentration. Results are shown in Table 6.

Table 6

| aluminosilicate | remaining activity |
|---|---|
| S-9 | 78.0% |
| S-10 | 72.1% |
| S-2 | 70.6% |
| S-11 | 63.2% |
| Molecular Sieve 4A of Showa Unox Co. (commercial product) | 10.1% |

EXAMPLE 6

(1) Synthesis of aluminosilicates

To an aqueous solution of 10 g of sodium aluminate in 50 cc. of deionized water, an aqueous solution comprising a mixture of 17 g of 40 wt.% aqueous sodium silicate ($Na_2O:SiO_2=1:2.5$) solution and aqueous solution of 6.8 g of sodium hydroxide in 50 cc. of deionized water was added. After effecting the reaction under stirring at a predetermined temperature for a predetermined period of time as shown in Table 7, the reaction product was separated out by filtration by means of suction and washed with deionized water to obtain four aluminosilicates P-1 through P-4.

(2) Measurement of degree of crystallization

Degree of crystallization of each of the partially crystallized aluminosilicates synthesized in above process (1) was determined according to powder X-ray diffraction by preparing a calibration image (X-ray diffraction 2=29.9°), taking the degree of crystallization of commercially available Molecular Sieve 4A as 100 (a product of Showa Unox K.K.).

Table 7

| Aluminosilicate | Reaction temp. | Reaction time | Form of crystal | Degree of crystallization | Structural formula supposed from chemical analysis values | Calcium ion uptake capacity *1 |
|---|---|---|---|---|---|---|
| P - 1 | 70° C. | 1 hr. | Amorphous | 0% | $0.8(Na_1O) . (Al_2O_3) . 1.9(SiO_2) . 4.2(H_2O)$ | 285 |
| P - 2 | 95 | 40 mins. | A-type | 50 | $0.75(Na_2O) . (Al_2O_3) . 1.9(SiO_2) . 4.2(H_2O)$ | 287 |
| P - 3 | 95 | 1.5 hrs. | A-type | 75 | $1.2(Na_2O) . (Al_2O_3) . 2.2(SiO_2) . 3.8(H_2O)$ | 290 |
| P - 4 | 95 | 4 hrs. | A-type | 100 | $1.0(Na_1O) . (Al_2O_3) . 2.1(SiO_2) . 4.4(H_2O)$ | 291 |
| Commercial molecular sieve | — | — | A-type | 100 | $1.0(Na_2O) . (Al_2O_3) . 2.0(SiO_2) . 4.5(H_2O)$ | 293 |

Table 7-continued

| Alumino-silicate | Reac-tion temp. | Reac-tion time | Form of crystal | Degree of crystal-lization | Structural formula supposed from chemical analysis values | Calcium ion uptake capacity *1 |
|---|---|---|---|---|---|---|
| 4A *2 | | | | | | |

*1 mg $CaCO_3$/g as anhydride
*2 a product of Showa Unox K.K.

EXAMPLE 7

Powdery bleaching detergent compositions comprising components as shown below were prepared, wherein sodium percarbonate was incorporated in the last step in the preparation. The compositions were stored in an airconditioned room of a relative humidity of 80% at 30° C. 30 Days after, the available oxygen concentration of sodium percarborate was measured. Residual activities were shown by the percentage of the available oxygen concentration based on available oxygen concentration directly after the preparation thereof. The results are shown in Table 8.

Table 8

| Sodium alumino-silicate | Degree of crystallization | Residual available oxygen |
|---|---|---|
| P - 1 | 0% | 75% |
| P - 2 | 50 | 70 |
| P - 3 | 75 | 63 |
| P - 4 | 100 | 22 |
| Commercial mole-cular sieve 4A | 100 | 25 |
| Sodium perborate* | — | 88 |

| Detergent composition: | | |
|---|---|---|
| Sodium straight chain dodecylbenzene sulfonate (containing 12 carbon atoms in average) | 20 | wt. % |
| Sodium aluminosilicate | 20 | |
| Sodium silicate | 5 | |
| Sodium percarbonate or sodium perborate | 17 | |
| Carboxymethyl cellulose | 1 | |
| Magnesium silicate | 1 | |
| Fluorescent dye, perfume | 0.7 | |
| Sodium sulfate | 25.3 | |
| Water | 10 | |

*For comparison, sodium percarbonate was replaced with sodium perborate and commercially available Molecular Sieve 4A was used as the aluminosilicate. It is understood from the results that sodium perborate has no stability problem.

With a degree of crystallization of less than 75%, an excellent stability of sodium percarbonate was exhibited in all cases, while with a degree of crystallization of higher than 75%, the stability of sodium percarbonate is reduced sharply.

EXAMPLE 8

| | | |
|---|---|---|
| Sodium straight chain dodecylbenzene sulfonate | 15 | wt. % |
| Sodium alkylsulfate (containing 14.5 carbon atoms in average: oxoalcohol derivative) | 5 | |
| Sodium alkylethoxysulfate (containing 12.8 carbon atoms in average: a derivative of oxoalcohol added with 1.5 moles of ethylene oxide in average) | 5 | |
| Sodium aluminosilicate (P-2) | 15 | |
| Sodium tripolyphosphate | 15 | |
| Sodium silicate | 3 | |
| Sodium percarbonate | 20 | |
| Fluorescent dye, perfume | 0.7 | |

-continued

| | |
|---|---|
| Beef tallow soap | 5 |
| Water | 5 |
| Sodium sulfate | 19.8 |

A detergent composition comprising the above components was prepared and stored for 30 days and the remaining available oxygen was measured in the same manner as in Example 7 to reveal that it was 80%.

What is claimed is:

1. A bleaching detergent composition consisting essentially of:

(i) from 3 to 50% by weight of water-insoluble aluminosilicate having a degree of crystallization of 0 to 75% and having the formula:

$$X(M_2O)\cdot(Al_2O_3)\cdot Y(SiO_2)\cdot W(H_2O)$$

wherein M is sodium and/or potassium, and X, Y and W are mole numbers having the following values:

$0.7 \leqq X \leqq 1.2$ $1.8 \leqq Y \leqq 2.2$ and

W is zero or a positive number, (ii) from 5 to 50% by weight of water-soluble, synthetic, organic, surface active agent effective for washing clothes and selected from the group consisting of anionic surface active agents, nonionic surface active agents, amphoteric surface active agents and mixtures thereof, (iii) from 3 to 50% by weight of sodium percarbonate, and the balance is one or a mixture of water-soluble alkali metal salt ion sequestering agent for detergents, water-soluble alkali metal salt inorganic electrolyte for detergents and water-soluble recontamination preventing agent for detergents.

2. A bleaching detergent composition as claimed in claim 1, in which an amount of the aluminosilicate is from 5 to 50% by weight.

3. A bleaching detergent composition as claimed in claim 1, in which an amount of the surface active agent is from 10 to 30% by weight.

4. A bleaching detergent composition as claimed in claim 1, wherein the degree of crystallization of the water-insoluble aluminosilicate is 0 to 50%.

5. A bleaching detergent as claimed in claim 1, wherein the surface active agent is selected from the group consisting of:

(a) straight chain or branched alkylbenzene sulfonates having 10 to 16 carbon atoms in the alkyl group on the average, (b) alkyl or alkenylethoxy sulfates having a straight chain or branched alkyl or alkenyl group having 8 to 20 carbon atoms on the average and containing 0.5 to 8 moles on the average of added ethylene oxide units in the molecule, (c) alkyl or alkenyl sulfates having an alkyl or alkenyl group having 10 to 20 carbon atoms on the average, (d) alkane sulfonates having 10 to 20 carbon atoms on the average in the molecule, and (e) olefin sulfonates having 10 to 20 carbon atoms on the average in the molecule.

6. A bleaching detergent composition as claimed in claim 1, in which the aluminosilicate has a particle size of not greater than 100 microns.

7. A bleaching detergent composition as claimed in claim 1, in which the aluminosilicate has a calcium ion exchanging property of at least 150 mg, calculated as calcium carbonate, per gram of said aluminosilicate, calculated as the anhydride.

8. A bleaching detergent composition consisting essentially of: (i) from 3 to 50% by weight of water-insoluble aluminosilicate having exchangeable cations partially substituted by calcium and/or magnesium ions, having the formula:

$$A(M^{+}{}_2O)\cdot B(M^{2+}O)\cdot(Al_2O_3)\cdot C(SiO_2)\cdot D(H_2O)$$

wherein $M^+$ is alkali metal, $M^{2+}$ is calcium and/or magnesium, and A, B, C and D are the mole numbers of the respective components, in which A and B are positive numbers satisfying the relations: $0.7 \leqq A+B \leqq 1.2$ and $B/A+B=0.001$ to 0.1, C is a number in the range of $1.6 \leqq C \leqq 2.2$, and D is a positive number, (ii) from 3 to 50% by weight of water-soluble, synthetic, organic surface active agent selected from the group consisting of anionic surface active agents, nonionic surface active agents, amphoteric surface active agents and mixtures thereof, (iii) from 3 to 50% by weight of sodium percarbonate, and the balance is one or a mixture of water-soluble alkali metal salt ion sequestering agent for detergents, water-soluble alkali metal salt inorganic electrolyte for detergents and water-soluble recontamination preventing agent for detergents.

9. A bleaching detergent composition as claimed in claim 8 wherein the aluminosilicate has the same crystal structure as that of an aluminosilicate of the A type.

10. A bleaching detergent composition as claimed in claim 8 wherein the aluminosilicate is a water-insoluble aluminosilicate which is partially substituted by calcium.

11. A bleaching detergent composition as claimed in claim 8 wherein the aluminosilicate is a water-insoluble aluminosilicate which is partially substituted by calcium and magnesium.

12. A bleaching detergent composition as claimed in claim 8 wherein $M^+$ is sodium, potassium or a mixture thereof.

13. A bleaching detergent composition as claimed in claim 12 wherein $M^+$ is sodium.

* * * * *

UNITED STATES PATENT AND TRADEMARK OFFICE

CERTIFICATE OF CORRECTION

PATENT NO. : 4 208 295

DATED : June 17, 1980

INVENTOR(S) : Fumio Sai et al

It is certified that error appears in the above-identified patent and that said Letters Patent are hereby corrected as shown below:

Column 12, line 50; after "claim 1" insert ---or claim 8---.

Column 12, line 53; after "claim 1" insert ---or claim 8---.

Column 12, line 58; after "detergent" insert ---composition---.
after "claim 1" insert ---or claim 8---.

Column 13, line 9; after "claim 1" insert ---or claim 8---.

Column 13, line 12; after "claim 1" insert ---or claim 8---.

Signed and Sealed this

*Eleventh* Day of *November 1980*

[SEAL]

*Attest:*

SIDNEY A. DIAMOND

*Attesting Officer*

*Commissioner of Patents and Trademarks*